United States Patent [19]

Shultz et al.

[11] 4,111,853

[45] Sep. 5, 1978

[54] PARTICULATE COMPOSITION OF SODIUM ALPHA OLEFIN SULFONATE AND SODIUM SILICATE

[75] Inventors: Andrew Shultz, Deerfield; F. Quinn Stepan, Winnetka, both of Ill.

[73] Assignee: Stepan Chemical Company, Northfield, Ill.

[21] Appl. No.: 848,644

[22] Filed: Nov. 4, 1977

Related U.S. Application Data

[63] Continuation-in-part of Ser. No. 664,753, Mar. 8, 1976, abandoned.

[51] Int. Cl.[2] ..... C11D 1/14; C11D 3/08

[52] U.S. Cl. ..... 252/536; 252/555

[58] Field of Search ..... 252/535, 536, 555

[56] References Cited

U.S. PATENT DOCUMENTS

| | | | |
|---|---|---|---|
| 3,759,834 | 9/1973 | Parke et al. | 252/110 |
| 3,849,346 | 11/1974 | Kuwamura et al. | 252/531 |
| 3,887,614 | 6/1975 | Susuki et al. | 252/531 |
| 3,950,276 | 4/1976 | Grand | 252/536 |
| 3,951,880 | 4/1976 | Mausner et al. | 252/555 |
| 3,954,679 | 5/1976 | Wixon | 252/555 |

*Primary Examiner*—P.E. Willis, Jr.

*Attorney, Agent, or Firm*—Hill, Gross, Simpson, Van Santen, Steadman, Chiara & Simpson

[57] ABSTRACT

A surfactant composition adapted for use as an intermediate for particulate synthetic detergent formulations. The composition comprises sodium alpha olefin sulfonate and sodium silicate. Such compositions are in a homogeneous, storage stable, free-flowing, particulate form, and characteristically are only slightly hygroscopic.

4 Claims, No Drawings

PARTICULATE COMPOSITION OF SODIUM ALPHA OLEFIN SULFONATE AND SODIUM SILICATE

RELATED APPLICATION

This application is a continuation-in-part of our earlier filed U.S. Pat. application Ser. No. 664,753, filed Mar. 8, 1976, now abandoned.

BACKGROUND OF THE INVENTION

This invention lies in the field of particulate sodium alpha olefin sulfonate (Na AOS) compositions.

There is a need in the art of synthetic detergent formulations for a particulate form of Na AOS whose physical characteristics would make it compatible with other ingredients commonly employed in synthetic detergent formulations (syndets). This need arises out of the circumstance that syndets are commonly compounded for particular end use applications, so that an individual syndet can vary in terms of relative percentages of ingredients and in terms of ingredients present. This dictates the flexibility of the compounder; for example, the larger the percentage of inert material present with a particulate Na AOS the more limited would be the use field in which such a diluted Na AOS can be used. Each detergent formulation typically contains many different components; see "Chemical and Process Technical Encyclopedia" pp. 345–352, McGraw Hill Book Company (1974).

Specifically, in order to prepare the class of surfactants known as sodium alpha olefin sulfonates in such a suitable particulate form whose physical characteristics would make is compatible with other ingredients commonly employed in synthetic detergent formulations, various efforts have been made to dry aqueous solutions and suspensions of this class of pure surfactant without known commercial success. Sodium alpha olefin sulfonate (sometimes herein referred to as NaAOS) characteristically, upon being spray or drum dried in a substantially pure form, appears to characteristically demonstrate severe problems of thermoplasticity, tackiness, free flowability, insufficient flake or bead strength characteristics, hygroscopicity, and the like, regardless of drying conditions. At the present time, it does not appear generally possible to dry, as by drum or spray drying on a commercial scale, aqueous solutions or slurries of substantially pure NaAOS so as to produce a particulate product comprised substantially of just NaAOS which has suitable physical properties for commercial blending.

Particularly when a dried, particulate form of NaAOS is to be used in compounding syndets, it is not necessary for such a particulate NaAOS to have by itself good syndet properties, such as, for example, for laundry use; good syndet properties can be achieved for a laundry syndet by subsequent compounding using technology and know-how well known in the art.

The problems of preparing a particulate system rich in NaAOS are compounded by the fact that NaAOS is characteristically somewhat hygroscopic. Thus, for example, if a slurry of NaAOS is spray-dried, the product beads will usually slowly take up moisture from the surrounding air over a period of time which makes such pure NaAOS beads, which have been stored in air for a period of time characteristically, somewhat undesirable for use in formulating synthetic detergents. Moisture absorption and inherent thermoplasticity tend to result in agglomeration in packout, thus yielding a non-pourable product. In addition, spray drying of a slurry rich in NaAOS invariably results in severe adhesion of product on the walls of the drying chamber as well as in product conveying lines thus creating a significant yield loss in product packout, equipment fouling problems, and, more importantly, a potential fire hazard within the drying unit.

Somewhat better results in producing a commercially suitable particulate form of NaAOS have apparently been heretofore achieved in this art at least experimentally by incorporating into an aqueous solution or suspension of NaAOS which is to be spray or drum-dried quantities of some other inert (from a detergent composition standpoint) material, preferably one which is commonly used in detergent formulations, such as sodium sulfate. However, to date, so far as is how known, no one has heretofore ever been able to produce on a commercial scale a particulate form of intermediate surfactant material which is rich in NaAOS, which can be substantially completely comprised of active (from a detergent composition standpoint) components, and which, still at the same time, not only has a combination of physical properties making such particulate form compatible with other particulate agents commonly available and commonly used in formulating synthetic detergents, but also can be used in detergent formulating by simple dry blending techniques to produce an innumerable variety of synthetic detergent compositions intended for respective various specific end use applications and needs.

For example, a drum dried sodium alpha olefin sulfonate product is commercially available, but this product contains appreciable quantities of diluents, such as sodium chloride and sodium sulfate, as well as an additive to suppress dusting and "firm up" the flake. The presence of the diluents tends to limit syndet compounding applications.

Grant U.S. Pat. No. 3,950,276 teaches a phosphate-free laundry syndet composition containing olefin sulfonate, sodium silicate, non-ionic surfactant, and carboxymethyl cellulose. The Grant teachings contain no suggestion of a two-component bead type intermediate composition having utility as an intermediate in formulating synthetic detergent compositions, such as phosphate-free laundry syndet compositions.

Parke et al U.S. Pat. No. 3,759,834 convert drum dried olefin sulfonate to moisturized, translucent flakes through the addition thereto of water followed by milling. The post-adding of free water to drum dried NaAOS to make flakes does not teach or suggest dry, free flowing intermediate compositions for syndet compounding and does not solve the problem of providing a bead-type concentrate product suitable for multiple syndet compounding applications.

BRIEF SUMMARY OF THE INVENTION

The present discovery provides a new and very useful particulate NaAOS composition of two principle components which is adapted for use as an intermediate or concentrate in the preparation of particulate synthetic detergent formulations.

Such a composition consists on a 100 weight percent basis of a homogeneous mixture of (A) from about 25 to 65 weight percent of a sodium silicate having an $SiO_2$ to $Na_2O$ weight ratio of from about 1:1 to 2.8:1, (B) from about 25 to 65 weight percent of a sodium alpha olefin sulfonate derived from at least one alpha olefin containing from 14 to 18 carbon atoms per molecule, (C) from about 0.2 to 2 weight percent of a salt selected from the group consisting of sodium chloride and sodium sulfate, and (D) from about 4 to 15 weight percent water.

Such a composition is further characterized by (A) being in the physical form of a homogeneous, storage-stable, free-flowing group of beads, (B) having a hygroscopicity not greater than about 5 percent free water (total composition weight basis) after standing in an atmosphere of normal humidity, (C) having a particle size such that at least about 90 weight percent of such group particles have at least about two dimensions in the size range from about 0.001 to 1 millimeter, and (D) having a bulk density ranging from about 0.25 to 0.50 gram per milliliter tamped.

For purposes of this invention, the water content of a product composition as above characterized can be determined by sample ignition, or by a combination of sample oven drying followed by ignition. Suitable and preferred procedures for ignition and for oven drying are hereinbelow described (see Examples N and O). Typically, a composition of this invention contains from about 0.5 to 7 weight percent free water (sometimes herein referred to as free moisture), and from about 4 to 8 weight percent water of hydration, each on a 100 weight percent total composition basis, though variations are possible in these values.

The sodium chloride and/or sodium sulfate present in a product composition is inherently derived from the commercial method used for making NaAOS and it is not practical at the present time to purify a starting NaAOS by separating therefrom such small amounts of inorganic sodium salts, particularly from the standpoints of cost and commercial practicality. Indeed, such a level of such sodium chloride and/or sodium sulfate in a NaAOS formulation is regarded by many workers in the detergent industry as being negligible. For example, many prior art publications appear to ignore even the presence of such quantities of inorganic sodium salts when indicating, for example, surfactant weight percentage present in a syndet formulation. For purposes of technical accuracy, the characteristic presence of such small amounts of inorganic sodium salts is here detailed. Preparation of NaAOS is well known to the prior art and does not constitute as such a part of the present invention.

The term "bead" or "beads" as used herein in reference to a product composition of this invention has reference to small generally ball shaped bodies. Sometimes the beads in a product are present as granules which are conglomerates of loosely bound beads. Also, sometimes the beads are not uniformly spherical and contain imperfections owing to the method and exact conditions used in drying a starting suspension. Further, sometimes a small (under 2 weight percent on a total product weight basis preferably) amount of the beads fracture into smaller bodies or particles, depending upon circumstances.

In accord with this invention, such a composition as detailed above is prepared by spray drying at a temperature ranging from about 220° to 450° F. a starting aqueous suspension (e.g., a solution or a slurry) comprised initially on a 100 weight percent total suspension basis of from about 35 to 65 weight percent total solids, and, correspondingly, from about 35 to 65 weight percent water. Such solids themselves comprise a composition as above detailed on a 100 weight percent basis.

The product compositions of this invention are produced from such a starting suspension in a two-step-type process sequence comprising: (A) compounding of suspension, and (B) spray drying thereof. Such a process sequence has obvious advantages over such prior art as Parke et al (above cited) wherein production of flakes involves the multiplicity of production steps: (1) drying of silicate, (2) preparation of NaAOS slurry, (3) drying of NaAOS, (4) blending of dried silicate and NaAOS, (5) moisturizing blend (4), (6) grinding of moisturized blend, (7) 3-roll milling of moisturized blend, and (8) classification of milled product. Furthermore the physical form (beads) of a product composition makes same directly useful in compounding most syndets because other syndet components commonly available are in a bead or particle form well suited from a physical standpoint for blending with a product composition of this invention (which would not be the case if the product were in a flake form).

A preferred product composition of this invention comprises from about 36 to 54 weight percent of sodium alpha olefin sulfonate characterized as above (and more preferably about 42 to 47 weight percent), and from about 54 to 36 weight percent of sodium silicate characterized as above (and more preferably about 48 to 43 weight percent).

Preferably, a product composition contains a sodium silicate which has an $SiO_2$ to $Na_2O$ weight ratio of about 2.4:1. Also, the alpha olefin used preferably is a mixture comprising molecules each having from 16 through 18 carbon atoms. Preferred product compositions are comprised of particles which have at least two dimensions each in the range from about 0.18 to 0.60 mm. and which have a bulk density in the range from about 0.35 to 0.45 grams per milliliter.

Furthermore, preferred compositions of this invention are characterized by having attrition numbers preferably not greater than about 25% (and, more preferably, not greater than about 20%). The term "attrition numbers" has reference herein to material that has been first screened through a 6 mesh sieve, or equivalent, and subsequently subjected to the "attrition test" as described herein. The attrition numbers obtained for spray dried products are characteristically substantially lower than about 20% while corresponding such numbers for drum dried compositions are characteristically lower than about 25%. Spray dried compositions preferably have attrition numbers which are not greater than about 15%, and, more preferably, are not greater than about 5%. One presently preferred class of compositions is in the form of beads characterized by having a size such that at least about 90 weight percent thereof have a number of average size distribution ranging from about 0.03 to 1.5 millimeters.

These compositional and chemical characteristics of a product composition are achieved without adversely affecting desired particulate product end use properties, such as water solubility, pH, foaming power, and wetting ability. Thus, a composition of this invention characteristically has a water solubility in distilled or deionized water such that at least about 10 grams of product (and preferably at least about 15 grams of product) are soluble in 100 milliliters of water. A very slight haze characteristic is present in such a product solution because of the characteristic behavior of sodium silicate in water solution. The pH of a water solution containing a concentration of a dissolved product of about 1 weight percent characteristically ranges from about 10.5 to 11.5 (and preferably about 10.7 to 11.1 pH). The foaming power of the product is characteristically such that an aqueous solution of about 0.1 weight percent by the Ross Miles foam test method demonstrates in distilled water a foam height of at least about 140 ml immediately, and after five minutes at least about 140 ml (and preferably at least about 150 ml immediately, and at least about 150 ml after five minutes). Similarly, the characteristic wetting ability of the product when in the form of a 0.1 weight percent aqueous solution by the Draves wetting ability test in distilled water demonstrates a wetting time of not more than about 70 seconds at 25° C., and not more than about 30 seconds at 50° C. (and preferably not more than about 67 seconds at 25° C., and not more than about 28 seconds at 50° C.).

Surprisingly and unexpectedly, the two component type silicate/sulfonate surfactant compositions of this invention have physical and even chemical characteristics which appear to be unattainable with any other practical binary composition of NaAOS with another component of the type used in detergent formulations. As examples of such other components, it is noted that NaAOS synthetic detergent compositions sold commercially typically contain, in addition to NaAOS, builder(s) (most commonly condensed polyphosphates, such as pentasodium tripolyphosphate or sodium tripolyphosphate), bleach(es) (most commonly potassium dichloroisocyanurate, chlorinated trisodium phosphate, sodium perborate, or the like), corrosion inhibitors (most commonly soluble sodium silicates which also contributes to detergency through their added alkalinity), sudsing modifiers (mono- and diethanolamides of $C_{10-16}$ fatty acids being commonly used as sudsing boosters, and $C_{16-22}$ fatty acids or ethoxylated fatty alcohols being commonly used as sudsing depressors), fluorescent whitening agents (such as sulfonated triazinylstilbenes for cellulosic fibers), enzymes (such as those derived from fermentation cultures of specific strains of boccili B. subtilis and B. licheniformis), antiredeposition agents (such as carboxymethyl cellulose and polyvinyl alcohol), hydrotopes (such as sodium xylene sulfonate, or diluents (such as sodium sulfate).

The silicate/sulfonate surfactant particulate compositions of this invention display free flowability, homogeneity, low hygroscopicity, and excellent storage stability. Also, such compositions are substantially not thermoplastic and non-tacky. Furthermore, such compositions are prepared from concentrated aqueous systems, which surprisingly are themselves homogeneous solutions, slurries or dispersions by spray (presently preferred) or drum drying procedures, in contrast to the comparably concentrated aqueous heterogeneous solutions usually characteristic of other binary detergent-type compositions wherein one component is NaAOS. In addition, and importantly, the compositions of this invention display complete detergent functionality which is not possible or practical with most other binary detergent type compositions wherein one component is NaAOS.

From another aspect, the silicate/surfactant compositions of this invention are also surprising and unexpected. Thus, such compositions appear to have a water of hydration which is apparently substantially less than the water of hydration content of a substantially pure, dried particulate sodium silicate having comparable size characteristics to compositions of the present invention (the sodium silicate being chemically similar to that used as a starting material in the comparable compositions of this invention). The NaAOS component in effect holds onto water as free moisture; water is apparently not chemically bound as water of hydration thereto. As respects such surfactant compositions of this invention, in the case of the silicate component, such reduction in water of hydration is surprisingly achieved without loss of water solubility characteristics, while as respects the NaAOS component, the presence of water of hydration surprisingly and unexpectedly does not impair, but rather seemingly improves, dried product characteristics, especially as regards, for example, thermoplasticity and hydroscopicity, without adversely affecting such properties, as, for example, free flowability. In a product composition of this invention, there thus arguably appears to be a species of synergistic coaction between the sodium silicate and the NaAOS as respects water of hydration. Such coaction may be an important factor in achieving the above indicated desirable physical properties associated with a product composition of this invention. While total water minus free moisture equals water of hydration part of the "loosely held" water of hydration in silicate is liberated in the free water assay.

A product composition of this invention does not, however, display particularly good detergent properties by itself. Thus, for example, when a product composition of this invention is used as a laundry syndet, it is found, as might be expected by one skilled in the art of synthetic detergents, that the cleansing power achieved is not as good as the cleansing power achieved by the laundry synthetic detergent composition described by Grant (above cited).

The particulate surfactant compositions of this invention can be simply and readily dry-mixed with other dry, particulate components with similar physical properties. The product syndet blends have excellent, desired synthetic detergent properties. Thus, the present invention makes possible a wide variety of very useful syndets in a highly economical and efficient manner.

In addition to dry compounding, a composition of this invention can be added to, for example, partially formulated slurries and pastes, then thoroughly mixed in, for example, a crutcher, and subsequently deaerated, and finally spray dried. Because such compositions are in a "dry" bead form, addition to a crutcher can reduce water requirements for slurry preparation with attendant improvement in spray drying rates.

Furthermore, a composition of this invention can be used for silicate soaps wherein such is added, for example, to a plodder with little or no water to give a generally homogeneous mass which is adapted for subsequent extrusion into bars of soap.

DETAILED DESCRIPTION

Sodium silicate in the compositions of this invention performs multiple functions:

(1) It disperses or helps peptize, the soil that is removed from a fabric being cleansed;

(2) It aids in the prevention of soil redeposition;

(3) It is a corrosion inhibitor for the aluminum parts employed in most commercial and home laundry machines;

(4) It exhibits buffering capacity to maintain pH level; and (5) It helps emulsify and sponify oily and fatty soils.

In these compositions, as those skilled in the art will appreciate, the ratio of $SiO_2$ to $Na_2O$ is such that the less the $SiO_2$ content, the more the $Na_2O$ present, and the more one approaches the pH of caustic soda in water solution. Generally, compositions of this invention employ a sodium silicate whose weight ratio of $SiO_2$ to $Na_2O$ falls in the range from about 1:1 to 2.8:1, and preferably in the range from about 2:1 to 2.5:1. $SiO_2$/-$Na_2O$ ratios generally above 2.0/1.0 are effective for corrosion inhibition and are preferred.

Dried sodium silicate characteristically contains a total water content ranging from about 17 to 24 weight percent, and preferably about 17 to 19 weight percent. If a given sodium silicate contains smaller amounts of water, say, for example, from about 15 weight percent down to 0 weight percent water, as one goes down in the amount of water content, the solubility feature of the sodium silicate in water is reduced, so that, at about 0 weight percent water, the silicate is only soluble with difficulty in water, if at all, presumably because the silicate is converted into a siliceous, relatively insoluble material. Consequently, the water content in a particulate sodium silicate is relatively critical in a composition of this invention, and such compositions should characteristically have a water of hydration content in a sodium silicate particulate material which is at a level where desirable water solubility characteristics are certain to be achieved.

Sodium alpha olefin sulfonate surfactants are biodegradable according to the standards established by the Soap and Detergents Association. Thus, NaAOS is well over 90% biodegradable by the Shake Culture and by the Semi-Continuous Activated Sludge test procedures adopted by such Association as industry standards. Conventionally, sodium alpha olefin sulfonate is made from an alpha olefin containing from about 14 through 18 carbon atoms per molecule, though commonly and for reasons of commercial availability, alpha olefin starting materials containing from about 15 or 16 carbon atoms to 18 carbon atoms per molecule are employed. For example, when using an alpha olefin feedstock containing from about 15 to 18 carbon atoms per molecule, the distribution of carbon atoms in the complex molecular mixture comprising such an alpha olefin can be about 31% $C_{15}$, about 29% $C_{16}$, about 25% $C_{17}$, and about 10% $C_{18}$ (on a total 100 weight percent composition basis). Characteristically also, for example, when employing a mixed alpha olefin starting material containing from 16 to 18 carbon atoms per molecule, such mixture can contain about 50 weight percent $C_{16}$ and about 50 weight percent $C_{18}$ components (same total weight basis). Other molecular weight distributions can be employed apparently about equally satisfactorily for most surfactant purposes. The sodium chloride and/or sodium sulfate is present in a composition of this invention because these salts are inherently present with NaAOS owing to the methods employed commercially for the manufacture of NaAOS.

Compositions of this invention, can, of course, optionally contain minor amounts (e.g., preferably less than about 5 weight percent in all on a 100 weight percent total dry composition basis) of such known additive materials as anti-dusting agents, such as ethoxylated alkylolamides (available commercially under the trademark "AMIDOX L-2" from the Stepan Chemical Company), and the like; anti-tack or crisping agents, such as trisodium sulfosuccinate, a pyrogenic silica (available commercially under the trademark "Cab-O-Sil EH-5" from Godfrey L. Cabot Co., or under the trademark "Aerosil 200" from Degussa, Inc.), calcium silicate (available commercially under the trademark "Microcel E" from Johns Manville Co), silicon dioxide (commercially available as Zeosyl 110SD from J. M. Huber Corporation), sodium silico aluminate (commercially available as Zeolex 23A from J. M. Huber Corporation), and the like; hydrotopes, such as sodium xylene sulfonate, and the like; and others, as those skilled in the art will appreciate, without departing from the spirit and scope of this invention. Also, if desired, a composition of this invention can be prepared so as to contain up to about 20 weight percent, and sometimes more, of the conventional inerts or extenders commonly employed in the soap and detergent industry, such as sodium sulfate, and the like. Such known additives and extenders, it will be understood, will be present in a starting slurry, solution, or dispersion in homogeneous combination with sodium silicate and surfactants prior to drying, as by spray or drum drying.

When such a starting slurry, dispersion, or solution contains more than about 40 weight percent of solids on a total suspension weight basis, including silicate, NaAOS and sodium sulfate, it is preferred to have a hydrotope present in an amount as indicated above (e.g. less than about 5 weight percent) to promote uniformity of such slurry, solution, or dispersion immediately before and during the drying operation, as when a starting slurry so being charged to a spray drier and it is desired to avoid curd formation and/or stratification of slurry components in pipes, etc. For such plant operating reasons, it is presently preferred to have present in a starting aqueous suspension at least about 0.5 (but less than about 5) weight percent (total dry composition weight basis) of sodium xylene sulfonate because of its hydrotope properties.

Starting suspension compositions are prepared by any convenient procedure. Conveniently, a sodium silicate having a weight ratio of $SiO_2$ to $Na_2O$ in the range above indicated in prepared as an aqueous solution. Commonly, such solutions are available commercially, and such contain a concentration of suitable sodium silicate conveniently in the weight range of from about 42 to 48 weight percent (100 weight percent solution basis). Also, a NaAOS is prepared as an aqueous solution. Commonly, such solutions are conventionally prepared as an integral part of the manufacture of NaAOS, and such contain a concentration of NaAOS conveniently in the weight range of from about 38 to 48 weight percent (100 weight percent solution basis). The preparation of respective such starting solutions is well known to the prior art.

Such respective starting solutions or slurries/as the case may be are conveniently blended together so as to produce a mixed solution or slurry which is characteristically completely homogeneous and wherein the respective quantities of NaAOS and sodium silicate are within the ranges above indicated for a desired composition of this invention.

Thereafter, the mixed solution or slurry is spray dried at temperatures in the range above indicated which can be accomplished using operational conditions for spray drying equipment which are broadly known to the prior art. For example, such a mixed solution is delivered by high-pressure pump(s) to the atomizing nozzles or via low-pressure pumps to spinning disks or vaned rotating wheels of a spray-drying tower under a pressure of from about 400 to 1100 psig for nozzles or under a pressure of from about 5 to 50 psig for spinning disks or rotating wheels. Air may also be injected just prior to the nozzles to aid in puffing the droplets in the tower. Droplets exiting from the nozzles into the top of the tower are puffed into granules or beads and dried by a current of hot (typically ranging in the neighborhood of about 400° to 450° F. at entry though lower temperatures down to about 250° F. can be employed) air flowing through the tower (countercurrently or concurrently, depending upon design and operation of equipment. Spray tower sizes vary widely within the detergent industry. Some of the newer, high capacity commercial towers are as large as 25 feet in diameter and about 100 feet tall.

Granules or beads exit from the bottom of the tower and are carried away by, for examples, conveyor belts, vibrating conveyors, gravity flow to storage bins, air conveying to silos, or the like. The product can be cooled by contact with either ambient or preconditioned air, and then minor ingredients, such as perfume, or the like, which are too sensitive to pass through the spray-drying operation, may be admixed with, or sprayed on, the product beads or granules. The finished beads or granules are then transferred by some handling system, such as a pneumatic system, or the like, to a silo, or to a finished product packaging line, all as desired.

Typical air flow rates range from about 16,000 to 100,000 SCFM at air pressures ranging from about 0.7 to 1 atmosphere. Typical solids residence times range from about 0.5 to 10 seconds.

Preferably, a starting suspension is preheated to a temperature in the range from about 150° to 180° F. though higher and lower such temperatures can, of course, be employed.

In spray drying, water vapor is separated substantially at the rate produced and while maintaining the interior of the drying zone at the temperature preferably ranging from about 250° to 350° F.

As indicated, a product composition of this invention is admixable with other particulate materials conventionally used in syndet compositions. Such other materials are commonly available commercially, and simple mechanical mixing procedures may be used for blending, such as baffled or unbaffled rotating drums, twin shell blender, plowhsare mixer (Littleford Lodige) or ribbon blender (Marion), auger mixer, or the like, as is well known in the art.

Commercial spray drying of substantially pure NaAOS solutions is impractical at best for a number of specific technical reasons. For one thing, a dry NaAOS is extremely thermoplastic at high (substantially pure) active organic strength. For another thing, because of this thermoplasticity, such a dry product adheres to surfaces, and would adhere to the walls of a spray drying tower resulting in a potential fire and explosion hazard, among other obvious problems. For example, any product that did not stick on tower walls would "snowball" or agglomerate into "doughballs" which would plug the drier system causing an automatic shutdown. These problems are particularly troublesome with an NaAOS made with an alpha olefin mixture involving $C_{14}$ to $C_{18}$ alpha olefins and are further magnified by introduction of lower molecular weight alpha olefins, i.e. under $C_{14}$.

Commercial drum drying of substantially pure NaAOS solutions is likewise impractical at best. The product thermoplasticity causes an accumulation of product to develop on drier knives like "taffy candy" rather than coming away therefrom as sheet, flake, or powder.

The gumming product must be hand-scraped away from knives, and the resulting product form has no known market. Such a NaAOS product would perhaps have to be cooled or frozen, and then micropulverized, at great equipment and processing cost; however, on attaining room temperature, the so-produced product would undoubtedly agglomerate, especially with NaAOS made with alpha olefin mixtures wherein lower carbon content (such as $C_{12}$, $C_{14}$, and $C_{15}$) olefins are present in significant quantities.

Sodium silicate materials of the type used in compositions of the present invention can, when in aqueous solution form, be spray dried to produce free-flowing, non-thermoplastic particulate products which are extremely hygroscopic.

EMBODIMENTS

The present invention is further illustrated by reference to the following Examples. Those skilled in the art will appreciate that other and further embodiments are obvious and within the spirit and scope of this invention from the teachings of these present Examples taken with the accompanying specification.

EXAMPLE A

From Philadelphia Quartz Company is obtained an aqueous solution containing about 42 weight percent sodium silicate having an $SiO_2$ to $Na_2O$ weight ratio of about 2.4/1, (100 weight percent basis).

EXAMPLE B

From Philadelphia Quartz Company is obtained an aqueous solution containing about 48 weight percent sodium silicate having an $SiO_2$ to $Na_20$ weight ratio of about 2.4/1, (100 weight percent basis).

EXAMPLE C

From Stepan Chemical Company is obtained an aqueous solution containing about 45.6 weight percent total dissolved solids and about 44 weight percent NaAOS (100 weight percent basis). The NaAOS is prepared by using an alpha olefin mixture in the $C_{15}$ to $C_{18}$ range having a carbon distribution (on a 100 weight percent total olefin basis) of about 31 weight percent $C_{15}$ molecules, about 29 weight percent $C_{16}$ molecules, about 25 weight percent $C_{17}$ molecules, and about 10 weight percent $C_{18}$ molecules.

EXAMPLE D

From Stepan Chemical Company is obtained an aqueous solution containing about 43.2 weight percent total dissolved solids and about 39.5 weight percent NaAOS (100 weight percent basis). The NaAOS is prepared by using an alpha olefin mixture in the $C_{16}$ to $C_{18}$ range having a carbon distribution (on a 100 weight percent total olefin basis) of about 50 weight percent $C_{16}$ molecules, and about 50 weight percent $C_{18}$ molecules.

EXAMPLE E

From Stepan Chemical Company is obtained an aqueous solution containing about 45.6 weight percent total dissolved solids and about 44 weight percent NaAOS (100 weight percent basis). The NaAOS is prepared by using an alpha olefin mixture in the $C_{16}$ to $C_{18}$ range having a carbon distribution (on a 100 weight percent total olefin basis) of about 50 weight percent $C_{16}$ molecules and about 50 weight percent $C_{18}$ molecules.

EXAMPLE F

For purposes of the present invention, the procedure used to determine "attrition number" is as follows: The fragility of the product flake is determined by subjecting a fixed volume of product to milling in a glass jar containing three rows of vertical vigreaux indentations spaced about 120° apart. The indentations or teeth serve to "rake" the product at least three times for each complete revolution of the jar. The ability of the product flake to withstand fracture during this "raking" process is reflected in the % Volume Loss after milling. This volume loss can be translated to a numerical value of "toughness" or "non-friability". Thus the higher the attrition number or % volume loss, the greater is the fragility of the product.

Procedure for Determining Attrition Number

The relative fragility of the screened product flake is determined using the following procedure:

a. Transfer 100 ml. of tamped screened product to 1000 ml. attrition test jar. This jar comprises a conventional-type quart wide mouth, flat bottomed glass vessel containing three circumferentially spaced vertically extending rows of circumferentially staggered Vigreaux indentations with 6 or 7 such indentations per row, each indentation being from about ⅜ to ½ inch deep radially.
b. Place on roller mill and mix for 20 minutes at a jar speed of 72 rpm. This equates to about 4320 "rakings" in the 20 minute test period.
c. Next, transfer product from jar to 100 ml. graduate. Tamp lightly, as in density determination, to constant volume. Record volume.
d. The volume of product before milling minus the volume after milling = % Volume Loss. The % Volume Loss is also arbitrarily referred to in this application as the "Attrition Number". Then:

$$\text{Attrition Number} = \frac{V_{1t} - V_{2t}}{V_{1t}} \times 100$$

where $V_{1t}$ = tamped volume of product before milling; and
$V_{2t}$ = tamped volume of product after milling.

Thus, an "attrition number" is the percent volume loss after a milling of the product.

EXAMPLE G

For purposes of the present invention, the procedure used to determine "free flowability" of a particulate solid material is as follows:

Of Free-Flowability

Definition:

The property of motion resulting from the freedom of the constituent particles to move independently of one another; the property of a type of motion where the cohesive forces between the same or similar substances are so minimal as to afford freedom of movement in pouring a given product from the confines of a prechosen container.

Procedure

This is accomplished by (a) noting the angle of repose assumed by the product before movement or flow of particles is initiated, and
(b) observing the ease of flow of the product particles though progressive plastic funnels having discharge orifices of 15 mm. and 10 mm (i.d) respectively.

EXAMPLE H

For purposes of the present invention, the procedure used to determine "homogeneity" of a particulate solid material is as follows:

Of Homogeneity

Definition:

The state of being uniform in composition and structure.

Procedure:

Strictly qualitative. The uniformity of a blend is determined by observing for (1) evidence of individual ingredients, (2) variation in particle size, (3) color differences between particles, and (4) classification or separation due to differences in particle density.

EXAMPLE I

For purposes of the present invention, the procedure used to determine "hygroscoposity" of a particulate solid material is as follows:

Of Hygroscopicity

Definition:

The state of readily adsorbing and retaining moisture.

Procedure:

Determined qualitatively by (1) exposure of spray dried material to ambient conditions of high relative humidity (75%), (2) squeezing material by hand to form a clump, and (3) dropping the clump on a hard surface (or rubbing between both hands) to assess the relative ease of disintegration of agglomerates.

EXAMPLE J

For purposes of the present invention, the procedure used to determine "storage stability" of a particulate solid material is as follows:

Of Storage Stability

Definition:

The state of being unvarying in chemical composition and physical state or condition.

Procedure:

Both qualitative and quantitative.

(1) Samples of products are analyzed before and after prolonged (6 months) storage. Products of this invention showed no significant changes in chemical composition.
(2) Similarly, samples of products of this invention before and after prolonged storage (6 months) show no significant change in tamped bulk density, fines, and free-flowability.

EXAMPLE K

For purposes of the present invention, the procedure used to determine the character of a starting aqueous mixture used to make a particulate solid product composition of this invention in terms of (a) "homogeneity" or "heterogeneity", and (b) true "solution" or "dispersion" is as follows:

Definitions:

Homogeneity:
The state of being uniform in composition and structure;
Heterogeneity:
The state of being detectably dissimilar in ingredients or constituents;
True solution:
The condition of being completely dissolved, a liquid containing a dissolved substance;
Dispersion:
The state of fine particles distributed more or less evenly throughout a medium;
Procedure:
Strictly qualitative. The character of a starting aqueous mixture as defined by the foregoing terms is assessed by visual means after noting the consistency and condition of the mixture under static and dynamic conditions (i.e. at rest and under moderate to vigorous agitation). The aqueous mixture is observed under agitation and at rest; the latter over a period of 1 to 90 seconds. Observe that the maximum residence time of the aqueous mixture in the pumping line to a Bowen spray head is preferably not in excess of about 90 seconds.

EXAMPLE L

For purposes of the present invention, the procedure used to determine "thermoplasticity" of a particulate solid material is as follows:
Of Thermoplasticity
Definition:
The state of being softened under heat.
Procedure:
A thermoplastic substance is quite rigid at normal temperatures and under normal conditions of stress. However, it is capable of deformation under heat and pressure. With the foregoing in mind, this property is assessed by visual observation of the product in various stages of drying.

On a drum drier, the relative flexibility of the product sheet issuing from the drier knives is assessed by flexing the sheet. Thermoplastic material behaves like rubber, non-thermoplastic cracks like "corn flakes". Similarly, the brittleness of the product in the drier pans is assessed by chopping the flake with a spatula. Thermoplastic flakes resist breakage and agglomerate under this treatment. Also, there is a tendency for the flakes to stick to the spatula like "taffy". In contrast, non-thermoplastic flakes are readily fractured with no perceptible adhesion to drier pans or spatula.

In spray tower operation, the product is sampled below the hopper fed by the cyclones and at the discharge point to the storage silos. At free moisture levels of 1¼% or under, compression of the product by hand to give a solid clump indicates that the product is thermoplastic. Failure of the material to respond in this manner indicates it is non-thermoplastic.

EXAMPLE M

For purposes of the present invention, the procedure used to determine "functionality" of a particulate solid product composition of this invention is as follows:
Of Functionality
Definition:
The state of being designed or developed chiefly from the point of view of use. A principal utility of a product of this invention is believed to be in heavy-duty laundry detergents and in various industrial and institutional cleaners as exemplified in the exemplary formulations below:

EXAMPLE M.1

HEAVY-DUTY LAUNDRY SYNDET

| Ingredients | % by weight (total wt. basis) | Mixing Order |
|---|---|---|
| Product of Example 7 (below) | 27.0 | 7 |
| BIO SOFT EA-8 | 5.0 | 5 |
| Sodium Tripolyphosphate (light grade) | 35.0 | 1 |
| Sodium carbonate (light grade) | 16.4 | 2 |
| Sodium Sulfate | 15.3 | 3 |
| Sodium Carboxymethylcellulose (Hercules 6-CTL or 7LT) | 1.0 | 4 |
| Tinopal 5BM | 0.15 | 6 |
| Tinopal RBS-200 | 0.15 | 6 |
| Colorant and Fragrance (as desired) | q.s. | |

Equipment: Rotating drum
Compounding Procedure
A. Charge 1,2,3 and 4 to drum and mix 5 minutes.
B. Atomize 5 at about 50° C onto resulting mixture, continue mixing until 5 has been uniformly distributed throughout dry blend. Avoid overmixing to prevent premature glomulation.
C. Next, add 6 and 7 followed by colorant and perfume as desired. Mix until a discrete particle or glomule is formed. Then discharge blender via 10 mesh sieve to packout hopper.

"Bio Soft EA-8" is an ethoxylated fatty alcohol nonionic surfactant available commercially from Stepan Chemical Company, Northfield, Illinois. "Tinopal 5BM" is a bis tri azinyl derivative of 4,4' diaminostilbene - 2,2'-disulfonic acid, sodium salt available commercially from Ciba Geigy Corporation, Summit, New Jersey. "Tinopal RBS-200" is a naptho-triazostilbene sulfonate, sodium salt available commercially from Ciba Geigy Corporation.

EXAMPLE M2

TRUCK WASH

| Ingredient | % by Wt. | Mixing Order |
|---|---|---|
| Product of Example 7 (below) | 35.0 | 4 |
| Sodium Sesquicarbonate | 20.0 | 3 |
| Trisodium Phosphate (dodecahydrate) | 25.0 | 1 |
| Sodium Tripolyphosphate (light granular) | 20.0 | 2 |
| Blue Colorant (FD & C Aluminum Lake) | q.s. | 5 |
| Fragrance | q.s. | 6 |
| | 100.0% | |

Equipment: Twin shell blender
Compounding Procedure:
A. Combine 1, 2, and 3; mix until uniform.
B. Incorporate the Product of Example 7, color, and fragrance into the formulation and mix until homogeneous.

| | |
|---|---|
| pH of 1% Solution: | 10.5 |
| Density: gm/ml: | 0.630 |
| Lbs./ft.$^3$ | 39.3 |

EXAMPLE M.3

WAX STRIPPER

| Ingredients | % by Wt. | Mixing Order |
|---|---|---|
| Product of Example 7 (Below) | 40.0 | 4 |
| Sequestrene* NA-4 | 2.0 | 3 |
| Sodium Carbonate (light, granular) | 29.0 | 2 |
| Trisodium Phosphate (dodecahydrate granular) | 29.0 | 1 |
| Colorant (FD & C Aluminum, Lake) | q.s. | 5 |
| Fragrance | q.s. | 6 |
| | 100.0% | |

Equipment: Ribbon blender.
Compounding Procedure:
A. Combine 1, 2, and 3; mix until uniform.
B. Continue the mixing and incorporate the STEPANSIL AS-50 (product of Ex.7) color and fragrance. Mix until homogeneous.

| | |
|---|---|
| pH of 1% Solution: | 11.2 |
| Density; gm/ml: | 0.590 |
| Lbs./ft.$^3$ | 36.8 |

"Sequestrane NA-4" is a tetrasodium ethylendiamine tetraacetate dihydrate available commercially from Ciba Geigy Corporation.

EXAMPLE M.4

WHITEWALL TIRE CLEANER

| Ingredient | % by Wt. | Mixing Order |
|---|---|---|
| Product of Example 7 (below) | 50.0 | 2 |
| Trisodium Phosphate (dodecahydrate granular) | 50.0 | 1 |
| Fragrance | q.s. | 3 |
| | 100.0% | |

Equipment: Plowshare mixer
Compounding Procedure:
A. Combine ingredients and mix until uniform.

| | |
|---|---|
| pH of 1% Solution: | 11.6 |
| Density; gm/ml: | 0.610 |
| Lbs./ft.$^3$ | 38 |

The performance of a product composition of this invention in three heavy-duty laundry detergents is assessed in accordance with the procedure detailed below:

Initially, the following formulations are prepared:

EXAMPLE M.5

| Ingredients | % by wt. | Mixing Order |
|---|---|---|
| 50/50 Silicate/Na-AOS (see Example 1 Below) | 30.0 | 7 |
| Sodium Tri-polyphosphate (Monsanto Light) | 35.0 | 1 |
| Sodium Carboxy methylcellulose (Hercules 7LT) | 2.5 | 2 |
| Tinopal 5BM | 0.35 | 3 |
| Tinopal RBS-200 | 0.35 | 4 |
| Sodium Carbonate (Flozan) | 15.9 | 5 |
| Sodium Sulfate (Technical) | 15.9 | 6 |

Equipment: Twin Shell Blender
Compounding Procedure:
A. Charge 1, 2, 3, 4, 5 and 6 to blender and mix for 5 minutes.
B. Next add 7 and mix for 5 minutes.

EXAMPLE M.6

| Ingredients: | % by wt. | Mixing Order |
|---|---|---|
| 50/50 Silicate/Na-AOS (See Example 1 below) | 24.0 | 7 |
| Bio Soft EA-8 | 5.0 | 8 |
| Sodium tripolyphosphate | 35.0 | 1 |
| $Na_2CO_3$ | 16.4 | 2 |
| $Na_2SO_4$ | 16.4 | 3 |
| CMC, Na-Salt | 2.5 | 4 |
| Tinopal 5BM | 0.35 | 5 |
| Tinopal RBS-200 | 0.35 | 6 |

Equipment: Twin Shell Blender
Compounding Procedure:
A. Charge 1, 2, 3, 4, 5 and 6 to a blender and mix 5 minutes.
B. Atomize 8 onto the resulting mixture and continue mixing until uniform.
C. Add 7 and mix for 5 minutes.

EXAMPLE M.7 (Prior Art)

Commercially available detergent:
Tide (8.7% as Phosphorus) (Proctor & Gamble)
Compounding procedure: Unknown
Exact formulation: Unknown
Procedure Summary: Detergency tests are run in tap water and 300 ppm water using:
1. Spangler Sebum Soil method of evaluating detergents.
2. Standard soiled test cloths from United States Testing and Test Fabrics.
3. Laboratory prepared clay soiled cotton.

Anti-Redeposition tests are run in tap water using the Lever Brothers method.

Conclusions:
1. The test products of Examples M.5 and M.6 performed equal to or better than the Tide of Example M.7 in cotton detergency.
2. Tide of Example M.7 is slightly better than the test products in detergency on the commercially available soiled test cloths.
3. Tide is significantly poorer than the test products in anti-redeposition on cotton.
4. In overall detergency and anti-redeposition the AOS and AOS/EA-8 syndet outperformed the Tide of Example M.7.

| TEST CONDITIONS FOR DETERGENCY | |
|---|---|
| Machine: | Terg-O-Tometer |
| Agitator Speed: | 90 CPM |
| Detergent Concentration: | 0.15% |
| Wash & Rinse Temperature: | 120° F |
| Wash Cycle: | 15 minutes |
| Rinse Cycle: | 2 Hand, Tap Water |
| Size of Swatches: | 4 ½" × 6" |
| Wash Load*: | 15 g./liter |

*For the Bandy Black Clay soiled cotton, this is 4 - 4½" × 6" swatches.

For the Sebum Soil and Clay soiled swatches each pot contained:
2 - 4½ inches × 6 inches Cotton
2 - 4½ inches × 6 inches 65/35 Polyester/Cotton Resin Treated.

2 - 4½ inches × 6 inches 65/35 Polyester Cotton with no Resin.

| TEST CONDITIONS FOR REDEPOSITION | |
|---|---|
| | (Lever Brothers Test) |
| Machine: | Terg-O-Tometer |
| Agitator Speed: | 90 CPM |
| Detergent Concentration: | 0.15% |
| Wash & Rinse Temperature: | 120° F |
| Wash Cycle: | 15 minutes |
| Rinse Cycle: | 2 – 3 minute rinses. |
| Soil Load: | 1.10 grams Bandy Black Clay/ 125° ml. |
| Wash Load: | 4 – 4½ × 6" cotton swatches |

The detergent and the clay are dispersed in the pots and the swatches are added and washed for 15 minutes. The swatches are then machine rinsed twice for 3 minutes. Upon completion of the second and fifth wash/rinse cycles the swatches are machine dried and measured on both sides for reflectance using the Gardner Reflectometer with a Tri-Green filter. The average of eight readings is reported. The higher the reflectance reading, the better the anti-redeposition properties of the test product.

TABLE 1

DETERGENCY ON CLAY SOILED COTTON

| Detergent | % Reflectance Average | Standard Deviation | 95% Confidence Limits |
|---|---|---|---|
| Tap Water | | | |
| AOS Syndet | 76.01 | 0.865 | ± 0.690 |
| AOS/EA-8 Syndet | 76.38 | 0.498 | ± 0.398 |
| Tide | 75.06 | 1.147 | ± 0.916 |
| 300 PPM Water | | | |
| AOS Syndet | 74.22 | 1.082 | ± 0.864 |
| AOS/EA-8 Syndet | 74.47 | 1.151 | ± 0.919 |
| Tide | 72.83 | 0.529 | ± 0.423 |

TABLE 2

Detergency On Sebum Soil/Clay Soiled Cotton (300 PPM Water)

| Detergent | % Reflectance Average | Standard Deviation | 95% Confidence Limits |
|---|---|---|---|
| First Cycle | | | |
| AOS Syndet | 76.77 | — | — |
| Tide | 76.35 | — | — |
| AOS/EA-8 Syndet | 76.92 | — | — |
| Second Cycle | | | |
| AOS Syndet | 75.67 | — | — |
| Tide | 75.10 | — | — |
| AOS/EA-8 Syndet | 76.50 | — | — |
| Third Cycle | | | |
| AOS Syndet | 73.80 | 0.308 | ± 0.348 |
| Tide | 73.00 | 0.158 | ± 0.179 |
| AOS/EA-8 Syndet | 75.47 | 0.369 | ± 0.418 |

TABLE 3

Detergency On Sebum Soil/Clay Soiled 65/35 Polyester/Cotton With Resin Finish (300 PPM Water)

| Detergent | % Reflectance Average | Standard Deviation | 95% Confidence Limits |
|---|---|---|---|
| First Cycle | | | |
| AOS Syndet | 79.85 | — | — |
| Tide | 79.85 | — | — |
| AOS/EA-8 Syndet | 79.27 | — | — |

TABLE 3-continued

Detergency On Sebum Soil/Clay Soiled 65/35 Polyester/Cotton With Resin Finish (300 PPM Water)

| | | | |
|---|---|---|---|
| Second Cycle | | | |
| AOS Syndet | 79.57 | — | — |
| Tide | 79.90 | — | — |
| AOS/EA-8 Syndet | 79.32 | — | — |
| Third Cycle | | | |
| AOS Syndet | 79.20 | 0.187 | ± 0.211 |
| Tide | 79.15 | 0.083 | ± 0.094 |
| AOS/EA-8 Syndet | 79.20 | 0.187 | ± 0.211 |

TABLE 4

Detergency On Sebum Soil/Clay Soiled 65/35 Polyester/Cotton With No Resin Finish (300 PPM Water)

| Detergent | % Reflectance Average | Standard Deviation | 95% Confidence Limits |
|---|---|---|---|
| First Cycle | | | |
| AOS Syndet | 79.80 | — | — |
| Tide | 79.90 | — | — |
| AOS/EA-8 Syndet | 79.75 | — | — |
| Second Cycle | | | |
| AOS Syndet | 79.42 | — | — |
| Tide | 79.87 | — | — |
| AOS/EA-8 Syndet | 79.77 | — | — |
| Third Cycle | | | |
| AOS Syndet | 78.95 | 0.166 | ± 0.187 |
| Tide | 78.85 | 0.050 | ± 0.056 |
| AOS/EA-8 Syndet | 79.40 | 0.274 | ± 0.309 |

TABLE 5

DETERGENCY DATA FOR SEBUM SOIL/CLAY SOILED FABRICS RUN IN TAP WATER

| Detergent | Cotton Reflectance, % 1st Cycle | 2nd Cycle | 3rd Cycle |
|---|---|---|---|
| AOS Syndet | 79.90 | 79.17 | 78.82 |
| Tide | 79.62 | 78.47 | 78.37 |
| AOS/EA-8 Syndet | 79.97 | 79.12 | 79.15 |
| 65/35 Polyester/Cotton (Resin Finish) | | | |
| AOS Syndet | 80.65 | 80.40 | 80.65 |
| Tide | 80.07 | 80.32 | 80.67 |
| AOS/EA-8 Syndet | 79.60 | 79.97 | 80.07 |
| 65/35 Polyester Cotton (No Resin Finish) | | | |
| AOS Syndet | 80.85 | 80.92 | 80.90 |
| Tide | 80.92 | 80.92 | 80.85 |
| AOS/EA-8 Syndet | 80.37 | 80.72 | 80.72 |

No significant differences between formulations are shown.

TABLE 6

| Detergent | % Reflectance Average | Standard Deviation | 95% Confidence Limits |
|---|---|---|---|
| Second Cycle | | | |
| AOS Syndet Ref. 595-28 | 79.27 | 0.916 | ± 0.732 |
| AOS/EA-8 Syndet Ref. 595-30 | 79.97 | 0.066 | ± 0.053 |
| Tide | 75.28 | 1.105 | ± 0.883 |
| Fifth Cycle | | | |
| AOS Syndet | 78.22 | 0.927 | ± 0.741 |
| AOS/EA-8 Syndet | 79.55 | 0.255 | ± 0.204 |
| Tide | 72.84 | 0.387 | ± 0.309 |

TABLE 7

DETERGENCY ON SOILED COTTON FROM TEST FABRICS AND UNITED STATES TESTING (Tap Water)

| Detergents: | Detergency Units (% Reflectance) U.S.T. | Test Fab. |
|---|---|---|
| Tide | 6.77 | 10.10 |
| AOS Syndet | 5.57 | 9.05 |
| AOS/EA-8 Syndet | 3.27 | 7.70 |

EXAMPLE N

For purposes of the present invention, the procedure used to determine "water of hydration" of a particulate solid product of this invention is as follows:

"Water of hydration" is not used herein in the strictest chemical sense of a definite amount of water in stoichiometric proportion in combination with a definite chemical substance as, for example, in crystals, e.g., calcium chloride, $CaCl_2 \cdot H_2O$, but is rather to be taken to mean the difference between the "total water content" of a particulate solid product of this invention and its "free moisture level" as defined in Example O.

The "total water content", for the purposes of this invention, is determined by a procedure involving measurement of the percentage weight loss on ignition, termed LOI, followed by suitable mathematical corrections which convert by calculation said LOI to a "percent total water content". Total water content is meant to include free moisture, water of hydration, water of imbibition, and constitutional water (chemically bound water).

Ignition is carried out at temperatures of 800°-900° C. As ignition of the organic components of the particulate solid product of this invention takes place concurrently during this procedure, it is necessary to apply appropriate correction factors (loss on ignition factors) to correct for this burning loss. Thus, it can be shown that:

$$\%H_2O - T = \left[\frac{1 + R + R^1}{1 + R - f_{Surf}}\right]\%LOI - \left[\frac{100\,[R^1 f_A + F_{Surf}]}{1 + R - f_{Surf}}\right]$$

where

%Surf = % surfactant solids (including salts, neutral oil, hydrotropes, etc.)

$f_{Surf}$ = loss on ignition factor for the surfactant $f_A$ = loss on ignition factor for the additive %LOI = % loss on ignition (LOI) for total spray dried sample $\%H_2O$-T = % total water %A = % additive and $$R = \frac{\%s}{\%\text{Surf}} \text{ and } R^1 = \frac{\%A}{\%\text{Surf}}$$

The above equation is derived from theoretical considerations of the ignition characteristics of the individual components, i.e. NaAOS surfactant sodium silicate, and additives that comprise the product of this invention.

EXAMPLE O

For purposes of the present invention, the procedure used to determine "free moisture level" of a particulate solid product of this invention is as follows:

"Free moisture level" of a particulate solid product of this invention is defined as the percentage of water that it readily removed, essentially reversibly, by heating at 105° C. for a period of 3 hours.

The procedure involves accurately measuring the weight loss of a 1 to 2 gram sample of particulate solid product thinly spread over the surface of a 70 mm. diameter crystallizing dish (or the like), heated in an oven at 105° C. for 3 hours.

EXAMPLE P

For purposes of the present invention the procedure used to determine "bulk density tamped" of a particulate solid product of this invention is as follows:

The density of blends of this invention is determined on a screened product by filling and refilling a tared 100 ml. graduated cylinder to mark, after tamping on a rubber grid (10 times), until the volume remained constant at 100 ml. The net weight of the product divided by 100 = gm/ml.

The following Examples illustrate embodiments of the present invention:

EXAMPLE 1

Using portions of the solution of Example B and portions of the solution of Example D, a mixed homogeneous batch suspension having the following composition is prepared:

| Component | Parts by Weight |
|---|---|
| Sodium silicate solution | 156 |
| NaAOS solution | 189 |
| (Total) | 345 |

The starting batch is prepared in a 40 gallon open top stainless steel tank and is agitated until a uniform suspension results at ambient conditions.

The resulting mixed suspension is subjected to spray drying using a cocurrent pilot plant spray drying tower manufactured by Bowen Engineering Company. The conditions of operation are as follows:

| | |
|---|---|
| Slurry feed rate (Moyno Utility pump) | 3.5 pounds/minute |
| Slurry feed temp. | 75-80° F. |
| Bowen spray head: | |
| Wheel dia. and type | 5 inch vaned |
| Disc speed | 18,000 rpm |
| Inlet air temp. (direct gas heat) | 390° F. |
| Outlet air temp. | 240° F. |

The dried product removed from the bottom of the tower is in the form of granules or beads at least about 90 weight percent (total weight basis) are in the form of granules or beads having diameters in the range from about 0.01 to 0.1 mm. Upon analysis of the product, it is found to comprise (100 weight % total composition basis):

About 41.74 weight percent sodium alpha olefin sulfonate having a composition as described above;

About 41.74 weight percent of sodium silicate having a composition as described above;

About 13.41 weight percent total water;
About 1.50 weight percent sodium chloride; and
About 1.60 weight percent sodium sulfate.

The product has the following additional characteristics:

| | |
|---|---|
| Free moisture | about 6.57 weight percent (100 weight percent total composition basis) |
| Bulk density tamped | about 0.56 gram per milliliter |
| Free flowability | yes |
| Thermoplasticity | no |
| Homogeneity | yes |
| Hygroscopicity | no |
| Storage stability | yes |
| Functionality | 100% |
| Attrition number | 1.8 |
| Color | off white |

The physical and chemical properties of this composition demonstrate that it is suitable for use as an intermediate in preparing particulate synthetic detergents. This material can be produced on commercial scale spray drying equipment.

EXAMPLE 2

Using portions of the solution of Example B and portions of the solution of Example D, a mixed homogeneous batch suspension slurry is prepared in a 40 gallon open top stainless steel tank and agitated until a uniform solution or slurry results at ambient conditions. The active composition is as follows:

| Component | Parts by Weight |
|---|---|
| sodium silicate solution | 156 |
| NaAOS solution | 189 |
| (Total) | 345 |

The resulting mixed suspension is subjected to spray drying using the same cocurrent pilot plant spray drying tower as in Example 1. The conditions of operation were as follows (the solution or slurry being pumped into the tower top via a Moyno utility pump):

| | |
|---|---|
| Slurry feed temp. | 75–80° F. |
| Slurry feed rate | 3.1 lbs./min. |
| Centrifugal atomizer | |
| Wheel dia. & type | 5 inch vaned |
| Wheel speed | 14,000 rpm |
| Air inlet temp. (direct gas heat) | 390° F. |
| Air outlet temp. | 240° F. |
| Air exhaust | 2000 c.f.m. |

The dried product removed from the bottom of the tower is in the form of granules or beads at least 90 weight percent of which range from 0.01 to 0.11 mm. The chemical composition (100 weight % total basis) comprises:

| | |
|---|---|
| NaAOS | 42.14 |
| Sodium Silicate | 42.14 |
| Total water | 12.60 |
| NaCl | 1.51 |
| $Na_2SO_4$ | 1.61 |

The product composition has the following additional characteristics:

| | |
|---|---|
| Water of hydration | 6.54 weight percent (total composition basis) |
| Free moisture | 6.06 weight percent (total composition basis) |
| Bulk density tamped | 0.544 gm./ml. |
| Free flowability | yes |
| Thermoplasticity | no |
| Homogeneity | yes |
| Hygroscopicity | no |
| Storage stability | yes |
| Functionality | 100% |
| Attrition number | 1.9 |
| Color | off white |

The physical and chemical properties of this composition demonstrate that it is suitable for use as an intermediate in preparing particulate synthetic detergents.

EXAMPLE 3

Using portions of the solution of Example B and portions of the solution of Example D, a mixed homogeneous batch solution is prepared in a 40 gallon open top stainless steel tank and agitated until a uniform suspension results at ambient conditions. The active composition is as follows:

| Component | Parts by Weight |
|---|---|
| sodium silicate solution | 156 |
| NaAOS solution | 189 |
| (Total) | 345 |

The resulting mixed suspension is subjected to spray drying using the same cocurrent pilot plant spray drying tower as in Example 1. The conditions of operation were as follows (the solution being pumped into the tower top via a Moyno utility pump):

| | |
|---|---|
| Slurry feed temp. | 75–80° F. |
| Slurry feed rate | 5.0 lbs./min. |
| Centrifugal atomizer | |
| Wheel dia. & type | 5 inch vaned |
| Wheel speed | 14,000 rpm |
| Air inlet temp. (direct gas heat) | 450° F. |
| Air outlet temp. | 258° F. |
| Air exhaust | 2000 c.f.m. |

The dried product removed from the bottom of the tower is in the form of granules at least 90 weight percent of which range from 0.020 to 0.155 millimeters. The chemical composition (100 weight % total basis) comprises:

| | |
|---|---|
| NaAOS | 42.14 |
| Sodium Silicate | 42.14 |
| Total water | 12.59 |
| NaCl | 1.51 |
| $Na_2SO_4$ | 1.61 |

The product has the following additional characteristics:

| | |
|---|---|
| Free moisture | 5.68 weight percent (total composition basis) |
| Bulk density tamped | 0.528 gm./ml. |
| Free flowability | yes |
| Thermoplasticity | no |
| Homogeneity | yes |
| Hygroscopicity | no |
| Storage stability | yes |
| Functionality | 100% |
| Attrition number | 2.0 |
| Color | off white |

The physical and chemical properties of this composition demonstrate that it is suitable for use as an intermediate in preparing particulate synthetic detergents.

EXAMPLE 4

Using portions of the solution of Example B and portions of the solution of Example D, a mixed homogeneous batch solution is prepared in a 40 gallon open top stainless steel tank. In addition, there is added to the mixture molten ethoxylated alkylolamide (available commercially under the trademark "Amidox L-2" from Stepan Chemical Company). The resulting mixture is agitated until a uniform suspension results at ambient conditions. The composition is as follows:

| Component | | Parts by Weight |
|---|---|---|
| Sodium silicate solution | | 104 |
| NaAOS solution | | 127 |
| Ethoxylated alkylolamide | 2.5 | |
| | (Total) | 233.5 |

The resulting mixture suspension is subjected to spray drying using the same cocurrent pilot plant spray drying tower as in Example 1. The conditions of operation were as follows (the suspension being pumped into the tower top via a Moyno utility pump):

| | |
|---|---|
| Slurry feed temp. | 72–80° F. |
| Slurry feed rate | 3.6 lbs./min. |
| Centrifugal atomizer | |
| Wheel dia. & type | 5 inch vaned |
| Wheel speed | 14,000 rpm |
| Air inlet temp. | |
| (direct gas heat) | 380° F. |
| Air outlet temp. | 240° F. |
| Air exhaust | 2000 c.f.m. |

The dried product removed from the bottom of the tower upon analysis is found to comprise (100 weight percent basis):

| | |
|---|---|
| NaAOS | 41.78 |
| Sodium silicate | 41.78 |
| Total water | 12.85 |
| Sodium chloride | 1.32 |
| Ethoxylated alkylolamide | 0.85 |
| Sodium sulfate | 1.42 |

This product is in the form of granules at least about 90 weight percent of which range in size from about 0.02 to 0.165 mm.

The product has the following additional characteristics:

| | |
|---|---|
| Free moisture | 5.48 wt. % (total composition) basis) |
| Bulk density tamped | 0.510 gm/ml. |
| Free flowability | yes |
| Thermoplasticity | no |
| Homogeneity | yes |
| Hygroscopicity | no |
| Storage stability | yes |
| Functionality | 100% |
| Attrition number | about 1.5 |
| Color | off white |

The physical and chemical properties of this composition demonstrate that it is suitable for use as an intermediate in preparing particulate synthetic detergents.

EXAMPLE 5

Using portions of the solution of Example B and portions of the solution of Example D, a mixed homogeneous batch suspension is prepared in a 40 gallon open top stainless steel rank. In addition, there is added to the mixture trisodium sulfosuccinate. The resulting mixture is agitated until a uniform suspension results at ambient conditions. The composition is as follows:

| Component | | Parts by Weight |
|---|---|---|
| Sodium silicate solution | | 104 |
| NaAOS Solution | | 127 |
| Trisodium sulfosuccinate | | 2.5 |
| | (Total) | 233.5 |

The resulting mixed suspension is subjected to spray drying using the same cocurrent pilot plant spray drying tower as an Example 1. The conditions of operation were as follows (the solution being pumped into the tower top via a Moyno utility pump):

| | |
|---|---|
| Slurry feed temp. | 70–75° F. |
| Slurry feed rate | 3.7 lbs./min. |
| Centrifugal atomizer | |
| Wheel dia. & type | 5 inch vaned |
| Wheel speed | 14,000 rpm |
| Air inlet temp. | |
| (Direct gas heat) | 380° F. |
| Air outlet temp. | 246° F. |
| Air exhaust | 2000 c.f.m. |

The dried product removed from the bottom of the tower upon analysis is found to comprise (100 weight percent basis):

| | |
|---|---|
| Sodium sulfate | 1.52 |
| NaAOS | 42.07 |
| Sodium silicate | 42.07 |
| Total water | 11.97 |
| Sodium chloride | 1.42 |
| Trisodium sulfosuccinate | 0.95 |

This product is in the form of granules at least about 90 weight percent of which range in size from about 0.02 to 0.165 mm.

The product has the following additional characteristics:

| | |
|---|---|
| Free moisture | 5.03 wt. %(total composition basis) |
| Bulk density tamped | 0.534 gm/ml. |
| Free flowability | yes |
| Thermoplasticity | no |
| Homogeneity | yes |
| Hygroscopicity | no |
| Storage stability | yes |
| Functionality | 100% |
| Attrition number | 3.0 |
| Color | off white |

The physical and chemical properties of this composition demonstrate that it is suitable for use as an intermediate in preparing particulate synthetic detergents.

EXAMPLE 6

Using portions of the solution of Example B and portions of the solution of Example E, a mixed homogeneous batch solution is prepared by first charging the portions of Example E solution to a tank. After the agitator is started, the portions of Example B solution are pumped into the tank and the mixture is heated to about 145° to 150° F. Before the portions of Example E solution are charged to the tank, sufficient sodium xylene sulfonate is charged to and dissolved in solution E to make this resulting solution contain 3.0 weight percent sodium xylene sulfonate (based on total weight of NaAOS plus sodium xylene sulfonate). The mixture in the tank is agitated until a uniform solution results. The composition is as follows:

| Components | Parts by Weight | Quantities |
|---|---|---|
| Sodium silicate solution | 135.41 | 13,541 lbs. |
| NaAOS solution with sodium xylene sulfonate | 147.72 | 14,772 lbs. |
| | 283.13 | 28,313 lbs. |

The resulting mixed solution or slurry is subjected to spray drying using a full-scale cocurrent spray drying tower manufactured by Bowen Engineering Company. The conditions of operation were as follows:

| | |
|---|---|
| Air throughput | 72,000 c.f.m. |
| Slurry feed temp. | 150° F. |
| Slurry feed rate | 9500 lbs./hr. |
| Slurry viscosity at 50° C. | 840 cps |
| Centrifugal atomization | |
| Wheel dia. & type | 11 inch vaned. |
| Wheel speed | 7200 rpm |
| Inlet air temp. (direct gas fired) | 380° F. |
| Outlet air temp. | 265° F. |
| Product density (tamped) | 0.38 gm/ml. |
| Particle size | 125 to 350 microns. |

The dried product removed from the bottom of the tower upon analysis is found to comprise (100 weight percent basis):

| | |
|---|---|
| NaAOS | 42.06 |
| Sodium silicate | 42.06 |
| Total water | 13.79 |
| Sodium chloride | 0.28 |
| Sodium xylene sulfonate | 1.32 |
| Sodium sulfate | 0.47 |

This product is in the form of granules at least about 90 weight percent of which range in size from about 0.10 to 0.34 mm.

The product has the following additional characteristics:

| | |
|---|---|
| Free moisture | 5.48 weight percent (total composition basis) |
| Bulk density tamped | 0.38 gm./ml. |
| Free flowability | yes |
| Thermoplasticity | no |
| Homogeneity | yes |
| Hygroscopicity | no |
| Storage stability | yes |
| Functionality | 100% |
| Attrition number | 2.0 |
| Color | off white |

The physical and chemical properties of this composition demonstrate that it is suitable for use as an intermediate in preparing particulate synthetic detergents.

EXAMPLE 7

A 40 weight percent aqueous solution of sodium xylene sulfonate is prepared, and a 40 weight percent aqueous solution of sodium sulfate is prepared. These solutions are blended with a mixed solution of portions of Example A solution and portions of Example E solution prepared in the manner taught in Example 6. The resulting starting mixture is a homogeneous solution or slurry (depending upon its temperature) having the following composition:

| Component | Parts by Weight | Solids or Actives |
|---|---|---|
| Sodium silicate solution | 160.0 | 67.2 |
| NaAOS solution | 164.5 | 67.2 |
| Sodium xylene sulfonate solution | 4.75 | 1.9 |
| Sodium sulfate solution | 84.3 | 33.7 |
| Total Batch 413.6 | | |

The resulting mixed suspension is subjected to spray drying using the same cocurrent pilot plant spray drying tower and same conditions of operation as in Example 1.

The dried product removed from the bottom of the tower upon analysis is found to comprise (100 weight percent basis):

| | |
|---|---|
| NaAOS | 33.65 |
| Sodium silicate | 33.65 |
| Total water | 12.95 |
| Sodium chloride | 1.61 |
| Sodium xylene sulfonate | 0.95 |
| Sodium sulfate | 17.20 |

This product is in the form of granules or beads at least about 90 weight percent of which range in size from about 0.02 to 0.165 mm.

The product has the following additional characteristics:

| | |
|---|---|
| Free moisture | 5.48 wt. % (total composition basis) |
| Bulk density tamped | 0.510 gm./ml. |
| Free flowability | yes |
| Thermoplasticity | no |
| Homogeneity | yes |
| Hygroscopicity | no |
| Storage stability | yes |
| Functionality | 100% |
| Attrition number | 3.0 |
| Color | Off white |

The total water in the silicate/surfactant blends of this invention is preferably of the order of about 12 $\pm$ 3%. Thus, with "Free moistures" preferably running about 5 $\pm$ 1%, the water of hydration is preferably in the neighborhood of about 4 to 9%.

The physical and chemical properties of this composition demonstrate that it is suitable for use as an intermediate in preparing particulate synthetic detergents.

Example 1 demonstrates that spray drying can be used to prepare a product of this invention. Examples 2, 3 and 4 illustrate various compositional types and spray drying ranges within the teachings of the present invention. Examples 4 through 7 demonstrate that various additives can surprisingly be present as minor components in compositions of this invention without adversely interferring with desired product properties.

Other and further objects, aims, purposes, embodiments, advantages and the like will be apparent to those skilled in the art from a reading of the present specification without departing from the spirit and scope thereof.

We claim:

1. A particulate surfactant composition adapted for use as an intermediate in the preparation of synthetic detergent formulations, said composition consists on a 100 weight percent basis of a homogeneous mixture of (A) from about 25 to 65 weight percent of a sodium silicate having an $SiO_2$ to $Na_2O$ weight ratio of from about 1:1 to 2.8:1, (B) from about 25 to 65 weight percent of a sodium alpha olefin sulfonate derived from at least one alpha olefin containing from 14 to 18 carbon atoms per molecule, (C) from about 0.2 to 2 weight percent of a salt selected from the group consisting of sodium chloride and sodium sulfate, and (D) from about 4 to 15 weight percent water, said composition being further characterized by (a) being in the physical form of a homogeneous, storage-stable, free-flowing group of beads, (b) having a hygroscopicity not greater than about 5 percent free water after standing in an atmosphere of normal humidity, (c) having a particle size such that at least about 90 weight percent of such group particles have at least about two dimensions in the size range from about 0.001 to 1 millimeter, and (d) having a bulk density ranging from about 0.25 to 0.50 gram per milliliter tamped.

said composition having been prepared by spray drying at a temperature ranging from about 220° to 450° F. an aqueous suspension comprised initially on a 100 weight percent total suspension basis of from about 35 to 65 weight percent total solids, and, correspondingly, from about 35 to 65 weight percent water, said solids comprising a composition as above detailed on a 100 weight percent basis.

2. A surfactant composition of claim 1 additionally containing on a 100 weight percent total product composition basis from about 0.5 to 2.0 weight percent of sodium xylene sulfonate.

3. A surfactant composition of claim 1 wherein on a 100 weight percent total product composition basis the amount of sodium alpha olefin sulfonate ranges from about 36 to 54 weight percent and the amount of sodium silicate ranges from about 36 to 54 weight percent, and (A) said sodium alpha olefin sulfonate contains an alpha olefin mixture comprising molecules each having from 16 to 18 carbon atoms, (B) said sodium silicate has an $SiO_2$ to $Na_2O$ weight ratio of about 2.4:1, (C) said composition is in the form of beads characterized by having a size such that at least about 90 weight percent thereof have a number of average size distribution ranging from about 0.03 to 1.5 millimeters, and (D) said composition has a bulk density in the range of from about 0.35 to 0.45 gram per milliliter tamped.

4. The surfactant composition of claim 3 wherein on a 100 weight percent total product composition basis (A) said sodium alpha olefin sulfonate ranges from about 42 to 48 weight percent, and (B) said sodium silicate ranges from about 42 to 48 weight percent.

* * * * *